US009532630B2

(12) United States Patent
Giard et al.

(10) Patent No.: US 9,532,630 B2
(45) Date of Patent: Jan. 3, 2017

(54) BAG WITH ADJUSTABLE MOUTH AND VARIABLE DIAMETER CORDING

(71) Applicant: Under Armour, Inc., Baltimore, MD (US)

(72) Inventors: Edward Giard, Severna Park, MD (US); Stephen Cleary, Severna Park, MD (US); Edward Russell, Baltimore, MD (US); Michael J. Meyer, Baltimore, MD (US); Jonathan Brown, Alameda, CA (US)

(73) Assignee: Under Armour, Inc., Baltimore, MD (US)

( * ) Notice: Subject to any disclaimer, the term of this patent is extended or adjusted under 35 U.S.C. 154(b) by 189 days.

(21) Appl. No.: 14/461,033

(22) Filed: Aug. 15, 2014

(65) Prior Publication Data

US 2014/0355908 A1 Dec. 4, 2014

Related U.S. Application Data

(63) Continuation of application No. 13/403,601, filed on Feb. 23, 2012, now Pat. No. 8,833,625.

(51) Int. Cl.

| | |
|---|---|
| ***A45F 5/02*** | (2006.01) |
| ***A45F 3/02*** | (2006.01) |
| ***A45C 7/00*** | (2006.01) |
| ***A45F 3/04*** | (2006.01) |
| ***A45C 13/30*** | (2006.01) |
| ***A45C 13/10*** | (2006.01) |

(52) U.S. Cl.

CPC ..... *A45C 7/0063* (2013.01); *A45C 13/1046* (2013.01); *A45C 13/30* (2013.01); *A45F 3/04* (2013.01); *A45F 3/047* (2013.01)

(58) Field of Classification Search

CPC ..... A45F 3/04; A45F 5/02; A45F 3/12; A45F 3/047; A45F 3/02; B63C 11/02; A44B 11/25

See application file for complete search history.

(56) References Cited

U.S. PATENT DOCUMENTS

| | | | | |
|---|---|---|---|---|
| 4,213,549 | A | 7/1980 | Hibbard | |
| 4,466,124 | A | 8/1984 | Kirkham, Jr. | |
| 4,674,664 | A | 6/1987 | Simon | |
| 4,796,752 | A | 1/1989 | Reimers | |
| 4,810,102 | A * | 3/1989 | Norton | A45C 1/04 150/108 |
| 4,815,640 | A | 3/1989 | Johnson | |

(Continued)

*Primary Examiner* — Brian D Nash

(74) *Attorney, Agent, or Firm* — Maginot, Moore & Beck LLP

(57) ABSTRACT

An apparatus for carrying objects includes a bag and at least one cord. The bag has a top portion and a bottom portion. The top portion of the bag includes an adjustable mouth and a channel. The cord includes a first end portion coupled to the bottom portion of the bag, a second end portion coupled to the bottom portion of the bag, and a middle portion positioned between the first end portion and the second end portion. The middle portion of the cord includes a first length of cord which extends slidably through the channel and a second length of cord which is positioned outside of the channel. The second length of cord has a substantially larger diameter than the first length of cord.

20 Claims, 5 Drawing Sheets

(56) References Cited

U.S. PATENT DOCUMENTS

| | | | | | |
|---|---|---|---|---|---|
| 5,012,964 | A * | 5/1991 | Falletta | B63C 11/26 | 224/153 |
| 5,158,220 | A | 10/1992 | Glass | | |
| 5,187,823 | A | 2/1993 | Ferguson | | |
| 5,653,337 | A | 8/1997 | Cirigliano | | |
| D398,148 | S | 9/1998 | Jones | | |
| 5,895,118 | A | 4/1999 | Hensley | | |
| 5,957,354 | A * | 9/1999 | Mentken | A45F 3/04 | 224/601 |
| D421,521 | S | 3/2000 | Howard | | |
| 6,435,391 | B1 | 8/2002 | Vazquez | | |
| 7,083,331 | B2 | 8/2006 | Nykoluk | | |
| D553,356 | S | 10/2007 | Frago | | |
| D611,707 | S | 3/2010 | Hock | | |
| D619,807 | S | 7/2010 | Hock | | |
| 2004/0179756 | A1 | 9/2004 | Kani | | |
| 2006/0228051 | A1 | 10/2006 | Yu | | |
| 2006/0289588 | A1 | 12/2006 | Lindberg | | |
| 2013/0048691 | A1* | 2/2013 | Meyer | A45F 3/12 | 224/579 |
| 2013/0048694 | A1* | 2/2013 | Meyer | A45F 3/047 | 224/627 |
| 2015/0173491 | A1* | 6/2015 | Lesch | A45F 3/04 | 224/656 |

* cited by examiner

BAG WITH ADJUSTABLE MOUTH AND VARIABLE DIAMETER CORDING

CROSS-REFERENCE TO RELATED APPLICATIONS

This application is a continuation of U.S. patent application Ser. No. 13/403,601, filed Feb. 23, 2012.

FIELD

This application relates to the field of carrying bags and, particularly, to bags having variable diameter cording.

BACKGROUND

Carrying bags come in a wide variety of forms and styles. As used herein, the term "bag" refers to any of various different types of carrying bags including, packs, duffels, totes, sacks, and any of various other types of bags.

A backpack style carrying bag, commonly called a backpack, may be useful for some applications because it allows the wearer to distribute the weight of the bag over both shoulders and the back. Additionally, both of the wearer's hands may be free while carrying a backpack.

Backpacks are also found in a variety of forms. Trekking backpacks, used for hiking and camping expeditions, may include internal or external frames made of carbon fiber or aluminum, have capacities of 100 liters, include additional straps that cross the wearer's chest, waist and hips to better distribute weight and weigh 8 pounds when empty. For everyday use, a trekking backpack may be unnecessarily large and bulky and a smaller, simpler backpack may meet the wearer's needs. For example, for transporting a few lightweight items, cinch sacks or sack packs (which may also be referred to as drawstring backpacks) with capacities of around 8 liters and weights of just a few ounces may be sufficient.

Cinch sacks are designed with cords in the form of straps, ropes, strings, or other cords that double as drawstrings to control the opening at the top of the bag. In a common example of a cinch sack, the straps of the cinch sack pass through a channel that surrounds the opening at the top of the bag. When the opening is opened, the channel is elongated and large portions of the straps are drawn into the channel. When the opening is closed, the channel is cinched so that it is shortened and smaller portions of the straps are drawn into the channel. This design allows for simplicity as the assembly may require as little as a simple sack and two drawstrings resulting in relatively low manufacturing costs for the drawstring backpacks. However, when the wearer dons the cinch sack, the drawstrings may dig into the shoulders of the wearer, particularly if the cinch sack is laden with a significant amount of weight.

There is a need, therefore, for an improved cinch sack that addresses issues associated with using a simple carrying bag to transport significant weight. In view of the foregoing, it would be advantageous to provide an improved cinch sack which allows a wearer to maintain comfort while using the cinch sack to transport significant weight. It would be further advantageous if this cinch sack does not have increased complexity such that the original benefits of using a small, simple bag are not lost.

SUMMARY

In accordance with one embodiment of the disclosure, there is provided an apparatus for carrying objects including a bag and at least one cord. The bag includes a mouth configured to vary in size between an open position and a more closed position. The at least one cord includes a first portion, a second portion, and a middle portion positioned between the first portion and the second portion. The middle portion includes a first length of cord and a second length of cord. The first length of cord slideably extends through the channel. The second length of cord is positioned outside of the channel. The second length of cord has a substantially larger diameter than the first length of cord.

In accordance with another embodiment of the disclosure, there is provided a cinch sack including a bag having a top portion and a bottom portion. An adjustable mouth is positioned in the top portion of the bag and defines an opening to the interior of the bag. The cord guide is associated with the mouth in the top portion of the bag. The at least one cord includes a first length of cord and a second length of cord. The first length of cord extends through the cord guide. The second length of cord is positioned outside the cord guide. The second length of cord has a wider diameter than the first length of cord.

In accordance with yet another embodiment of the disclosure, there is provided an apparatus for carrying objects including a bag, a mouth, a cord guide, a first length of cord and a second length of cord. The bag has an interior, an exterior, a top portion and a bottom portion. The mouth is positioned in the top portion of the bag. The mouth defines an opening to the interior of the bag. The mouth is also configured to vary in size between an open position and a more closed position. The cord guide is associated with the mouth in the top portion of the bag. The first length of cord extends through the cord guide when the mouth is in the open position. The second length of cord is positioned outside of the cord guide when the mouth is in the open position. The first length of cord has a substantially smaller diameter than the second length of cord.

The above described features and advantages, as well as others, will become more readily apparent to those of ordinary skill in the art by reference to the following detailed description and accompanying drawings. While it would be desirable to provide a cinch sack having variable diameter cording that provides one or more of these or other advantageous features, the teachings disclosed herein extend to those embodiments which fall within the scope of the appended claims, regardless of whether they accomplish one or more of the above-mentioned advantages.

BRIEF DESCRIPTION OF THE DRAWINGS

Features of the cinch sack having variable diameter cording are apparent to those of ordinary skill in the art from the following description with reference to the following drawings.

DESCRIPTION

Figure 1:
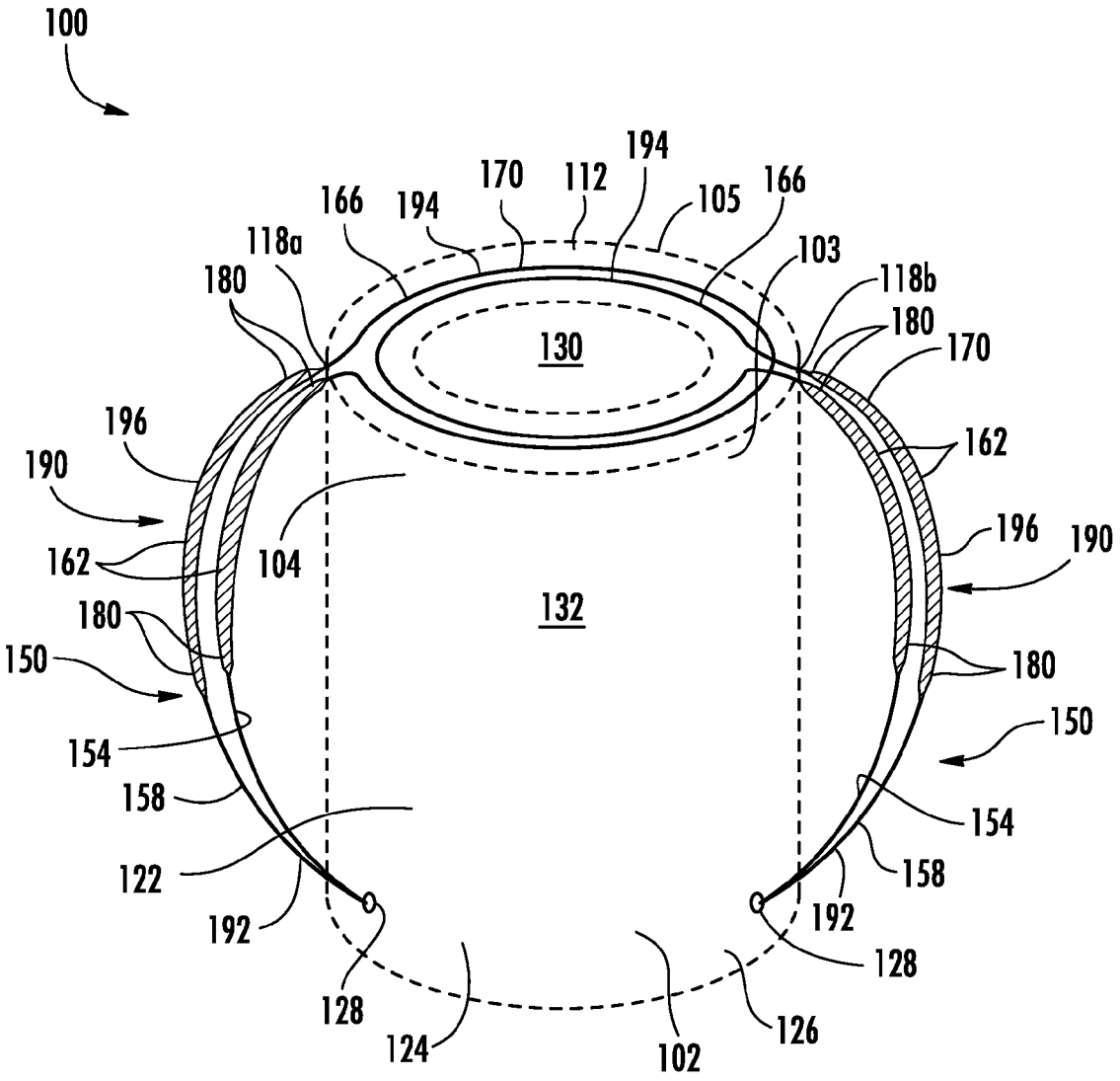
FIG. 1 depicts a front perspective view of the cinch sack, including cords and a bag, in an open configuration.

FIG. 1 depicts a cinch sack 100. The cinch sack 100 includes a bag 102 and cords 150. The bag 102 includes a front portion 103, a top portion 104, a back portion 105, a bottom portion 122, an interior 130 and an exterior 132. Each cord 150 includes a first end portion 154, a second end portion 158 and a middle portion 170 (also shown in FIG. 4*a*). Each middle portion 170 includes shoulder portions 162, a channel portion 166 and transition portions 180. Each cord 150 varies in diameter along its length such that some portions of the cord 150 are thicker than others. The first end portions 154 and second end portions 158 of the cords 150 are coupled to the bottom portion 122 of the bag 102 in the manner discussed below. The channel portions 166 of the cords 150 are coupled to the top portion 104 of the bag 102 in the manner discussed below.

Figure 2:
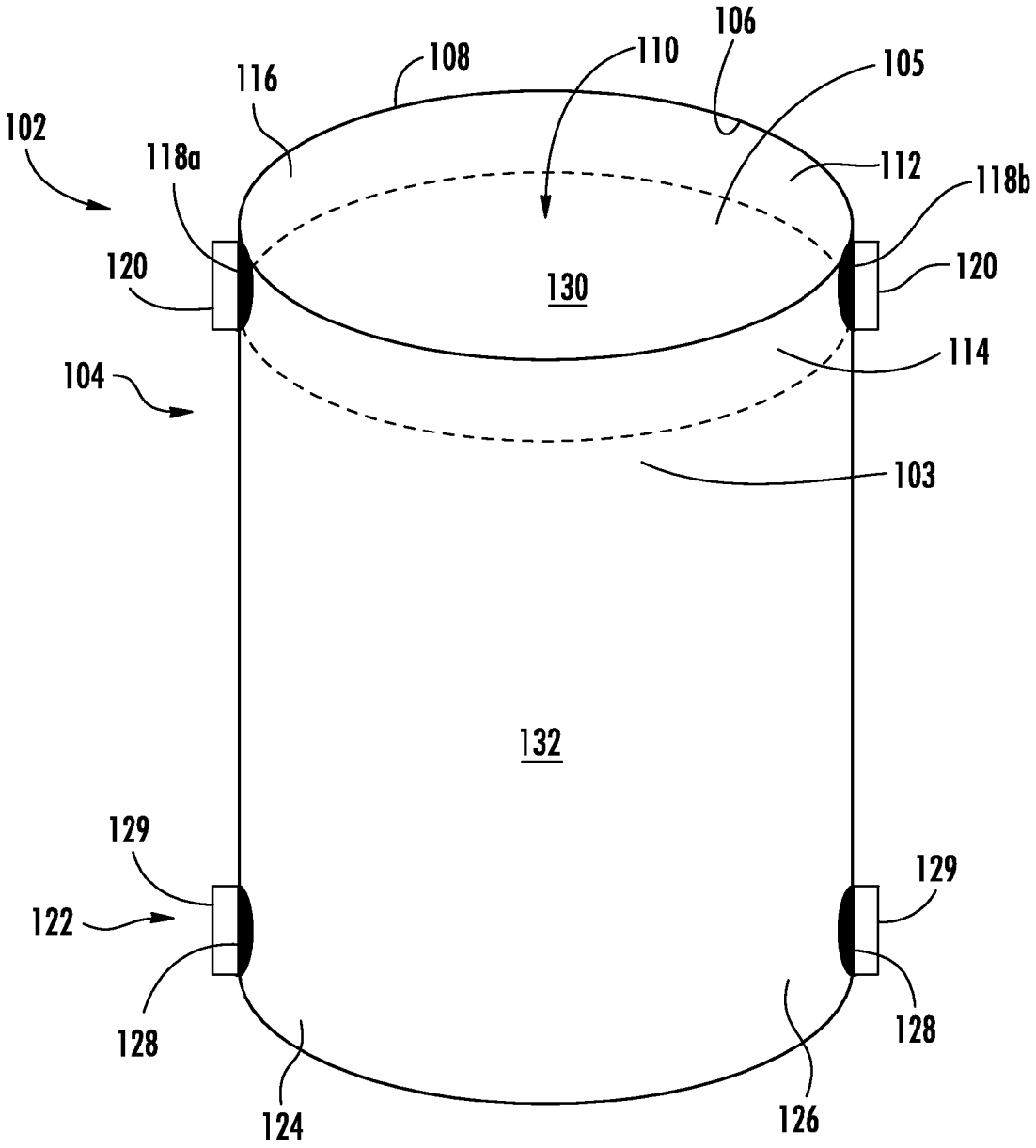
FIG. 2 depicts a front view of the bag of the sack pack FIG. 1.

FIG. 2 depicts the bag 102 of the cinch sack 100 with the cords 150 removed to better illustrate various features of the bag 102. The top portion 104 of the bag 102 includes a mouth 106 and an elongated channel 112. The mouth 106 has a perimeter 108 and the channel 112 extends along the perimeter 108. The mouth 106 also defines an opening 110 which provides access to the interior 130 of the bag 102.

The channel 112 is sized and configured to slideably receive the channel portions 166 of the cords 150 (as shown in FIG. 1). The channel 112 is made up of a front side 114 which extends along the front portion 103 of the top portion 104 of the bag 102 and a back side 116 which extends along the back portion 105 of the top portion 104 of the bag 102. The front side 114 and back side 116 of the channel 112 are opposite one another and, together, serve as a cord guide to direct the cords 150 around the perimeter 108 at the mouth 106 of the bag 102 (as shown in FIG. 1). The channel 112 also includes a first channel opening 118*a* and a second channel opening 118*b* which provide access for the cords 150 from the exterior 132 of the bag 102 to the channel 112. The first and second channel openings 118*a*, 118*b* are positioned opposite one another at the two junctions of the front side 114 and the back side 116 of the channel 112. The first and second channel openings 118*a*, 118*b* each have a channel opening diameter 120 which is large enough to pass the channel portions 166 of each of the cords 150 (as shown in FIG. 1).

With continued reference to FIG. 2, the bottom portion 122 of the bag 102 includes a left side 124 and a right side 126, each of which includes an eyelet 128. Each eyelet 128 has an eyelet diameter 129 that is sized and configured to receive the first end portions 154 and the second end portions 158 of the cords 150 (as shown in FIG. 1). The eyelets 128 provide access for the first end portions 154 and second end portions 158 from the exterior 132 of the bag 102 to the interior 130 of the bag 102.

Figure 3:
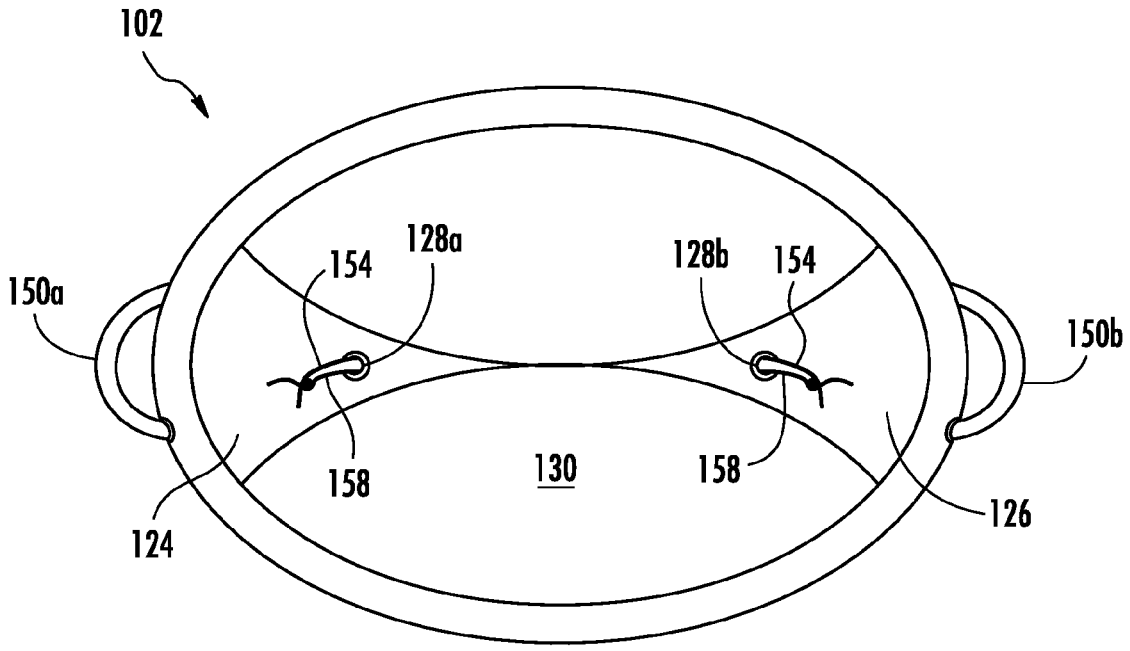
FIG. 3 depicts a top view of the cinch sack of FIG. 1.

As shown in FIG. 3 for clarity, the cord 150 includes a first cord 150*a* and a second cord 150*b* and the eyelet 128 includes a first eyelet 128*a* and a second eyelet 128*b*. The first end portion 154 and second end portion 158 of the first cord 150*a* are received in the first eyelet 128*a* on the left side 124 and tied together on the interior 130 of the bag 102 resulting in a knot that is sufficiently large such that the knot cannot be removed back through the first eyelet 128*a* unintentionally. Likewise, the first end portion 154 and second end portion 158 of the second cord 150*b* are received in the second eyelet 128*b* on the right side 126 and tied together on the interior 130 of the bag 102 resulting in a knot that is sufficiently large such that the knot cannot be removed back through the second eyelet 128*b* unintentionally. While a knot on the interior 130 of the bag 102 has been described herein as one means for securing the ends of the cords 150*a*, 150*b* to the bag 102, it will be recognized that numerous other means are possible for securing the ends of the cords 150*a*, 150*b* to the bag 102 in alternative embodiments.

Figure 4A:
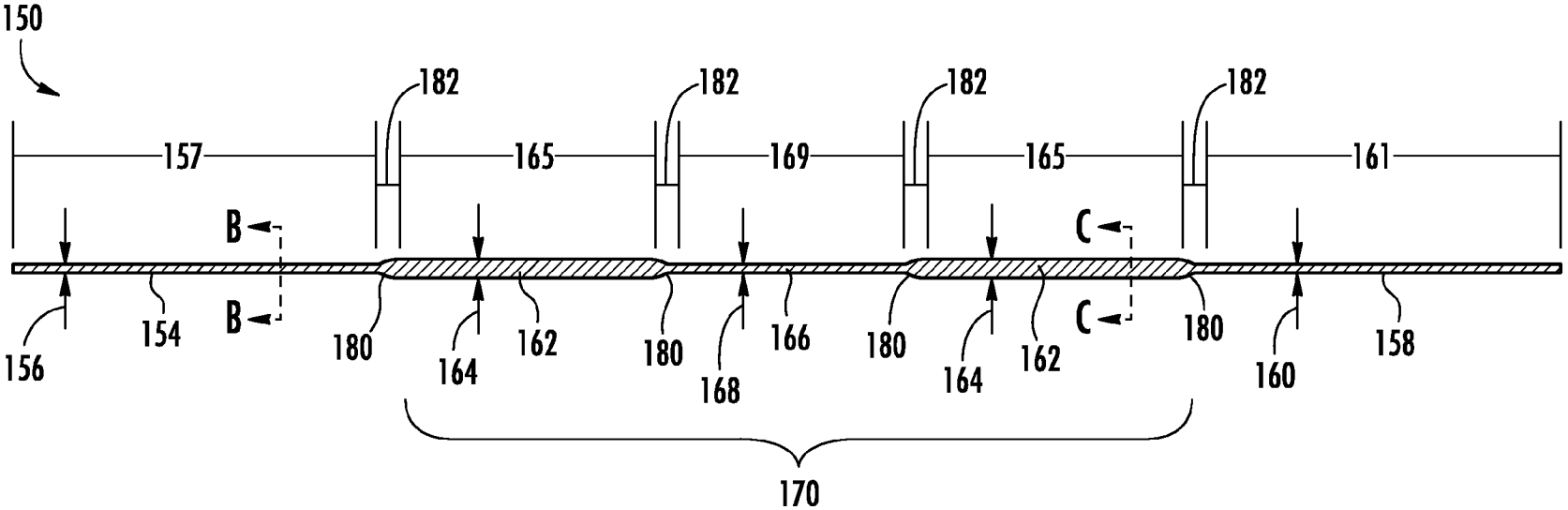
FIG. 4*a* depicts a side view of one of the cords of FIG. 1.

FIG. 4*a* depicts one of the cords 150 of the cinch sack 100 laid out in a straight line. As noted above, each cord 150 includes a first end portion 154 and a second end portion 158 on either end of the cord 150. Each cord 150 also includes a middle portion 170 in the center of the cord 150. Each middle portion 170 includes a channel portion 166 and a shoulder portion 162 on either side of the channel portion 166. Each middle portion 170 also includes transition portions 180 positioned on each end of each of the shoulder portions 162. Following along the cord 150 shown in FIG. 4*a* from left to right, there is a first end portion 154, a transition portion 180, a shoulder portion 162, a transition portion 180, a channel portion 166, a transition portion 180, a shoulder portion 162, a transition portion 180 and a second end portion 158.

Figure 4C:
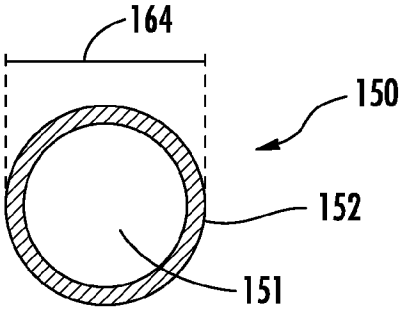
FIG. 4*c* depicts another cross-section of the cord along the line C-C of FIG. 4*a*.
Figure 4B:
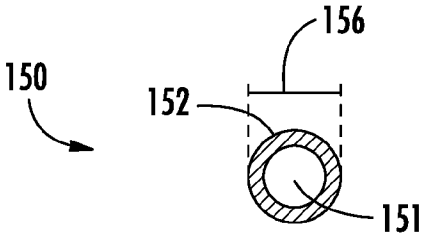
FIG. 4*b* depicts a cross-section of the cord along the line B-B of FIG. 4*a*.

FIG. 4*b* is a cross-sectional view of the cord 150 cut along the line B-B shown in FIG. 4*a* and having a diameter 156. Similarly, FIG. 4*c* is a cross-sectional view of the cord 150 cut along the line C-C shown in FIG. 4*a* and having a diameter 164. In the embodiment of FIGS. 4*b* and 4*c*, the cords 150 are made up of an inner portion 151 and an outer portion 152. The inner portion 151 is made out of a flexible cushioned material that is soft and springy. The inner portion 151 may be made out of a foam-like material, for example. The outer portion 152 is in the form of a casing for the inner portion 151. The outer portion 152 is made out of a stretchable elastic polymer material like elastane, nylon or polyester, for example, and may be shaped through the application of heat and pressure.

The cords 150 shown in FIGS. 4*b* and 4*c* are generally cylindrical in shape. In alternative embodiments, however, the cords 150 can have a different shape. For example, the cords 150 may be flat and strap-like or have a triangular cross-section. In embodiments where the cords 150 are not cylindrical, the term "diameter" refers to the widest parts of portions of the cords 150 being described at a particular location on the cord. Each cord 150 may be formed from several different lengths of cord that are connected together, with each length of cord having one or more different diameters. Alternatively, each cord 150 may be integrally formed as a unitary and continuous length of cord, with each cord having two different diameters.

A cord 150 having a relatively narrow diameter can slide within channels 112 more easily, enabling easy opening and closing of the bag 102 of the cinch sack 100. Additionally, a cord 150 having a relatively narrow diameter can be inserted through eyelets 128 more easily, enabling easy construction of the cinch sack 100. However, a cord 150 having a relatively narrow diameter may not be comfortable on the shoulders of a wearer who is wearing the cinch sack 100 on his back and may dig into the wearer's skin A cord 150 having a relatively wide diameter provides more surface area for weight distribution and a more cushioned surface for contact with the shoulders of a wearer who is wearing the cinch sack 100 on his back. However, a cord 150 having a relatively wide diameter may not slide easily within conventionally sized channels 112 and may not be easily inserted through conventionally sized eyelets 128. Thus, by varying the diameter of the cords 150, both the advantages of cords 150 having relatively narrow diameters and of cords 150 having relatively wide diameters can be utilized simultaneously as described below.

With reference again to FIG. 4*a*, the first end portion 154 has a first end diameter 156 and a first end length 157. The second end portion 158 has a second end diameter 160 and a second end length 159. Because the first end portion 154 and the second end portion 158 are simultaneously received within the eyelets 128 on the bottom portion 122 of the bag 102 (as shown in FIG. 1), the first end diameter 156 and the second end diameter 160 have a combined total diameter that is less than the eyelet diameter 129 (shown in FIG. 2). The first end diameter 156 and the second end diameter 160 are equivalent and may be less than 2.0 cm. For example, the first end diameter 156 and the second end diameter 160 may be 1.0 cm. In alternative embodiments, the first end diameter 156 and the second end diameter 160 may be larger or smaller, so long as the combined total diameter of the two is less than the eyelet diameter 129. Additionally, the first end diameter 156 and the second end diameter 160 may be a standard cord diameter conventionally used for such applications.

The first end length 157 and the second end length 159 are sized such that the transition portions 180 between the first end portion 154 and the adjacent shoulder portion 162 and between the second end portion 148 and the adjacent shoulder portion 162 are approximately aligned with a wearer's rib cage when the cinch sack 100 is worn on the wearer's back. The first end length 157 and the second end length 159 are equivalent and may be, for example, 52 cm. In alternative embodiments, the first end length 157 and the second end length 159 may be longer or shorter, so long as the shoulder portions 162 are approximately aligned with a wearer's shoulders when the cinch sack 100 is worn on the wearer's back.

Each shoulder portion 162 has a shoulder diameter 164 and a shoulder length 165. Each shoulder diameter 164 is larger than the first end diameter 156 and the second end diameter 160 and is large enough to provide additional surface area sufficient to distribute the weight of the cinch sack 100 and its contents to provide more comfort to the wearer. Additionally, in at least one embodiment, each shoulder diameter 164 is larger than the channel opening diameter 120 such that the shoulder portions 162 cannot be received within the channel 112. When the bag 102 is in the open configuration (as shown in FIG. 1), the shoulder portions 162 may abut the first and second channel openings 118*a*, 118*b*, but cannot enter the channel 112. The shoulder diameter 164 is greater than 2.0 cm and less than 4.0 cm and may be, for example, 2.5 cm. In alternative embodiments, the shoulder diameter 164 may be larger or smaller, so long as the shoulder portions 162 provide additional comfort to the wearer.

Each shoulder length 165 is sized such that it covers the weight bearing portion of a wearer's shoulders when the cinch sack 100 is worn on the wearer's back. By extending over the portion of the wearer's shoulders which bear the weight of the cinch sack 100, the shoulder portions 165 are able to provide added comfort to the wearer. The shoulder length 165 may be, for example, 43 cm. In alternative embodiments, the shoulder length 165 may be longer or shorter, so long as the shoulder portions 162 extend over at least the weight bearing portions of a wearer's shoulders.

The channel portion 166 has a channel portion diameter 168 and a channel portion length 169. The channel portion diameter 168 is smaller than the shoulder diameter 164. In one embodiment, the channel portion diameter 168 is less than half the shoulder diameter 164. In at least one embodiment, the channel portion diameter 168 is between one third and one half the shoulder diameter 164. The channel portion diameter 168 is sized such that the channel portions 166 of both cords 150 may be received and slide easily within the channel 112 of the bag 102 simultaneously (as shown in FIG. 1). The channel portion diameter 168 is also sized such that the channel portions 166 may pass through the channel openings 118*a*, 118*b* (as shown in FIG. 1). Because both ends of the channel portion 166 of one cord 150 are passed through the channel opening 118*a* and both ends of the channel portion 166 of the other cord 150 are passed through the channel opening 118*b*, the channel portion diameter 168 must be less than one half of the channel opening diameter 120. The channel portion diameter 168 is less than 2.0 cm and may be, for example 1.0 cm. In other embodiments, the channel portion diameter 168 may be wide enough to support the bag 102 of the cinch sack 100 while remaining narrow enough such that both ends of the channel portion 166 can pass through a channel opening 118*a*, 118*b* and narrow enough such that the channel portions 166 of both cords 150 can be received and slide within the channel 112.

Figure 5:
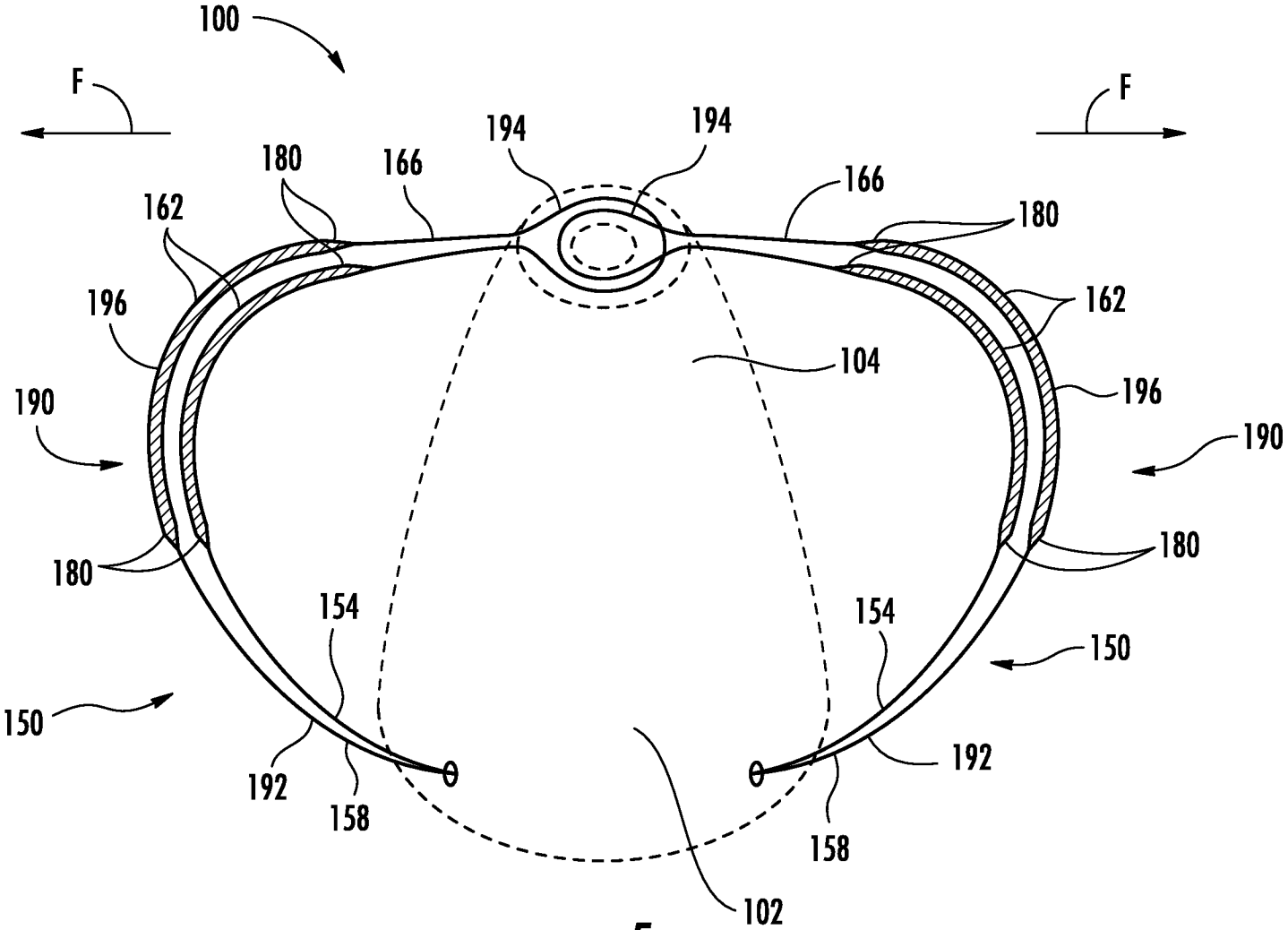
FIG. 5 depicts a front perspective view of the cinch sack of FIG. 1 in a more closed configuration.

The channel portion length 169 of each channel portion 166 is sized such that, when the top portion 104 of the bag 102 is in the open configuration (as shown in FIG. 1), the channel portion 166 of each cord 150 extends through the channel 112 and around the entire perimeter 108 of the mouth 106 of the bag 102. The channel portion length 169 is sized such that the channel portion 166 of one of the cords can enter the channel opening 118*a*, extend around the channel 112 and exit back out the same channel opening 118*a* through which it entered the channel 112. Likewise, the channel portion 166 of the other one of the cords 150 can enter the channel opening 118*b*, extend around the channel 112 and exit back out the same channel opening 118*b* through which it entered the channel 112. Additionally, the channel portion length 169 is sized such that, when the top portion 104 of the bag 102 is in the closed configuration (as shown in FIG. 5), portions of each channel portion 166 are extended out of the channel 112, allowing the shoulder portions 162 to align with the shoulders of the wearer who wears the cinch sack 100 on his back. The channel portion length 169 may be, for example, 70 cm. In alternative embodiments, the channel portion length 169 may be any length which is at least as long as the perimeter 108 of the mouth 106 of the bag 102 and which is sized such that the shoulder portions 162 align with the shoulders of a wearer when worn on the wearer's back. In at least one alternative embodiment, the channel portion length 169 may be, for example, 33 cm.

Each transition portion 180 has a transition length 182 and a transition diameter 184. The transition length 182 may be, for example 2.5 cm. The transition diameter 184 varies over the transition length 182 and tapers as it varies from a narrowest part that is less than 2.0 cm to a widest part of greater than 2.0 cm. The narrowest part may be, for example, 1.0 cm. The widest part may be, for example, 2.5 cm. The transition diameter 184 tapers to form a smooth transition between each of the portions of the cord 150. The transition portion 180 positioned between the first end portion 154 and the shoulder portion 162 is narrowest where it contacts the first end portion 154 and gradually increases in diameter to its widest where it contacts the shoulder portion 162. The transition portions 180 positioned between the shoulder portions 162 and the channel portion 166 are widest where they contact the shoulder portions 162 and gradually decrease in diameter to their narrowest where they contact the channel portion 166. The transition portion 180 positioned between the shoulder portion 162 and the second end portion 158 is widest where it contacts the shoulder portion 162 and gradually decreases in diameter to its narrowest where it contacts the second end portion 158. Thus, although the diameter varies along the length of the cord 150, the portions of the cord 150 are provided along a single uninterrupted length to form a constituent part. In this way, the cord 150 is a continuous length including the aforementioned portions and having at least two different diameters.

As shown in FIGS. 1 and 5, when the cords 150 are coupled to the bag 102 for use with the cinch sack 100, they are formed into loops 190 such that the first end portion 154 and the second end portion 158 are at the bottom 192 of the loop 190 to be coupled to the bottom portion 122 of the bag 102, and the channel portion 166 is at the top 194 of the loop 190 to be coupled to the top portion 104 of the bag 102. The shoulder portions 162 and the transition portions 180 are along the sides 196 of the loop 190. Each loop 190 is substantially symmetrical from one end to the other.

To produce the cinch sack 100 as shown in FIGS. 1 and 5, the following process may be undertaken. First, the cords 150 having variable diameters must be produced. The size and shape of the diameter of the cord 150 can be determined by covering the inner portion 151 with the outer portion 152 and then selectively applying heat and pressure to the cord 150. The polymer that makes up the outer portion 152 is able to be softened by the application of heat such that application of pressure to the softened polymer then alters the shape of the outer portion 152. When the outer portion 152 cools, the polymer re-solidifies in the new shape. Because the outer portion 152 contains the inner portion 151, altering the shape of the outer portion 152 inherently alters the shape of the inner portion 151. Thus, when the outer portion 152 is compressed and formed, the inner portion 151 is compacted within the new shape.

Next, the first end portion 154 of one of the cords 150 is coupled to the left side 124 of the bottom portion 122 of the bag 102. The second end portion 158 of the same cord 150 is then threaded through the first channel opening 118*a* and through the channel 112 which extends around the perimeter 108 of the opening 110 at the top portion 104 of the bag 102. The second end portion 158 is then threaded back through the first channel opening 118*a* and coupled with the first end portion 154 to the left side 124 of the bottom portion 122 of the bag 102. Likewise, the first end portion of the other cord 150 is coupled to the right side 126 of the bottom portion 122 of the bag 102. The second end portion 158 of that cord 150 is then threaded through the second channel opening 118*b* and through the channel 112. The second end portion 158 is then threaded back through the second channel opening 118*b* and coupled with the first end portion 154 to the right side 126 of the bottom portion 122 of the bag 102.

The first and second channel openings 118*a*, 118*b* are spaced apart on the top portion 104 of the bag 102 so that the cords 150 enter the first and second channel openings 118*a* and 118*b* at spaced apart locations. Thus, when both cords 150 are pulled outwardly from the channel 112 (in the direction shown by the arrows F in FIG. 5), they pull the cords 150 through the channel 112 in opposing directions which causes the opening 110 at the top portion 104 of the bag 102 to collapse inwardly. In this way, the bag 102 is reconfigured from having an open top in an open configuration (shown in FIG. 1) to having a more closed top in a more closed configuration (shown in FIG. 5). The mouth 106 of the top portion 104 of the bag 102 is capable of varying in size and is larger when the bag 102 is in the open configuration (shown in FIG. 1) and is smaller when the bag 102 is in the more closed configuration (shown in FIG. 5).

When the cinch sack 100 is in use and is being worn on the wearer's back, the bag 102 is in the more closed configuration and the top portion 104 is above the bottom portion 122 so that the bag 102 will retain items within the interior 130 of the bag 102 despite moderate changes to the orientation or position of the bag 102. When the cinch sack 100 is being worn, the cords 150 of the bag 102 extend over the wearer's shoulders and bear the weight of the contents of the bag 102. The configuration of the cords 150 and the orientation of the cords 150 relative to the bag 102 are such that, when the bag 102 is in the more closed configuration and is worn on a wearer's back, the shoulder portions 162 of the cords 150 align with the wearer's shoulders. This alignment provides additional comfort to the wearer because the cords 150 are wider and have larger diameters at the shoulder portions 162 than at the first end portion 154, second end portion 158 and channel portion 166. Thus, aligning the shoulder portions 162 with the wearer's shoulders allows the shoulder portions 162 contact the wearer's shoulders instead of the first end portion 154, second end portion 158 and channel portion 166. The shoulder portions 162 have greater surface area for distributing the weight of the contents of the bag 102 and are more padded. Thus, contact between the wearer's shoulders and the shoulder portions 162 prevents uncomfortable chafing and irritation that could be caused by contact between the wearer's shoulders and the thinner first end portion 154, second end portion 158 and channel portion 166 of the cords 150.

In an alternative embodiment, the cord 150 of the cinch sack 100 may be formed by coupling separate parts with different diameters, rather than by a continuous length of cord having a varying diameter. In this embodiment, the separate parts include the first end portion 154, the second end portion 158, the shoulder portions 162 and the channel portion 166. The separate parts are then coupled together in some known manner to form the cord 150.

In another alternative embodiment, the cinch sack 100 may include only one cord 150. In one embodiment, the cord 150 may be attached to the left side 124 of the bottom portion 122 of the bag 102 and may enter and exit the channel 112 through the first channel opening 118*a* at the top portion 104 of the bag 102 such that the cord 150 is on only one side of the bag 102. The right side 126 and the second channel opening 118*b* may be used in the reverse orientation of the same embodiment. In this embodiment, the wearer may wear the cinch sack 100 over only one shoulder, thus the cord 150 is configured such that the shoulder portions 162 of the cord 150 align with the wearer's shoulder.

In another embodiment including a cinch sack 100 having only one cord 150, the cord 150 may be attached to the right side 126 of the bottom portion 122 of the bag 102 and may enter and exit the channel 112 through the first channel opening 118*a* at the top portion 104 of the bag 102 such that the cord 150 is oriented across the bag 102. The left side 124 and the second channel opening 118*b* may be used in the reverse orientation of the same embodiment. In this embodiment, the wearer may wear the cinch sack over one shoulder and the chest, thus the cord 150 is configured such that the shoulder portions 162 of the cord 150 align with the wearer's shoulder and upper chest.

The foregoing detailed description of one or more embodiments of the bag with an adjustable mouth and variable diameter cording been presented herein by way of example only and not limitation. For example, an embodiment of the bag in the form of a cinch sack has been describe above, it will be recognized that the bag may take other forms in other embodiments, including, for example, a bag in the form of a pack or duffle or any other type of bag. Additionally, it will be recognized that there are advantages to certain individual features and functions described herein that may be obtained without incorporating other features and functions described herein. Moreover, it will be recognized that various alternatives, modifications, variations or improvements of the above-disclosed embodiments and other features and functions, or alternatives thereof, may be desirably combined into many other different embodiments, systems or applications. Presently unforeseen or unanticipated alternatives, modifications, variations or improvements therein may be subsequently made by those skilled in the art which are also intended to be encompassed by the appended claims. Therefore, the spirit and scope of any appended claims should not be limited to the description of the embodiments contained herein.

What is claimed is:

1. An apparatus for carrying objects comprising:

a bag including a mouth defining an opening to an interior of the bag and a channel associated with the mouth, the mouth configured to vary in size between an open position and a more closed position; and at least one cord including a first portion, a second portion, and a middle portion positioned between the first portion and the second portion, the middle portion including a first length of cord slideably extending through the channel and a second length of cord positioned outside of the channel, wherein the second length of cord has a larger diameter than the first length of cord.

2. The apparatus of claim 1, wherein the second length of cord has a substantially larger diameter than the first portion and the second portion of the cord.

3. The apparatus of claim 1, wherein the mouth is included on a top portion of the bag, and wherein the channel extends along a perimeter of the mouth.

4. The apparatus of claim 3, wherein the channel includes a channel opening, and wherein the second length of cord has a diameter that is greater than the channel opening.

5. The apparatus of claim 1, wherein the apparatus is a cinch sack, and wherein the second length of cord is configured to engage a shoulder of a human when the human carries the bag on the human's back with a top portion of the bag above a bottom portion of the bag and the at least one cord extending over the shoulder of the human.

6. The apparatus of claim 1, wherein the at least one cord includes a first cord and a second cord, wherein the first portion and the second portion of the first cord are a first end portion and a second end portion coupled to the bag and wherein the first portion and the second portion of the second cord are a first end portion and a second end portion also coupled to the bag.

7. The apparatus of claim 6, wherein the first end portion and a second end portion of the first cord are coupled to a bottom of the bag and wherein the first end portion and a second end portion of the second cord are also coupled to the bottom of the bag.

8. The apparatus of claim 1, wherein the at least one cord is comprised of an elastic material.

9. A cinch sack comprising:

a bag having a top portion and a bottom portion;

a mouth having an adjustable size positioned in the top portion of the bag, the mouth defining an opening to an interior of the bag;

a cord guide associated with the mouth in the top portion of the bag; and at least one cord coupled to the bag, the at least one cord including a first length of cord extending through the cord guide and a second length of cord positioned outside of the cord guide, wherein the second length of cord has a larger diameter than the first length of cord.

10. The cinch sack of claim 9, wherein the at least one cord includes end portions, shoulder portions, and a cord guide portion, wherein the cord guide portion is separated from the end portions by the shoulder portions.

11. The cinch sack of claim 10, wherein the shoulder portions have a larger diameter than the end portions and the cord guide portion.

12. The cinch sack of claim 11, the end portions, shoulder portions and cord guide portions are integrally formed as a continuous length of cord having at least two different diameters.

13. The cinch sack of claim 9, the first length of cord and the second length of cord integrally formed as a continuous length of cord having at least two different diameters.

14. The cinch sack of claim 9, wherein the cord guide is provided by an elongated channel formed along a perimeter of the mouth, the channel having a channel diameter, the larger diameter of the second length of cord being greater than the channel diameter.

15. The cinch sack of claim 9, wherein the first length of cord has a diameter less than 2.0 cm and the second length of cord has a diameter greater than 2.0 cm.

16. The cinch sack of claim 15, wherein the first length of cord has a diameter of about 1.0 cm and the second length of cord has a diameter of about 2.5 cm.

17. The cinch sack of claim 9 wherein the mouth is configured to vary in size between an open position and a substantially closed position.

18. An apparatus for carrying objects, the apparatus comprising:

a bag having an interior, an exterior, a top portion and a bottom portion;

a mouth positioned in the top portion of the bag, the mouth defining an opening to the interior of the bag, the mouth configured to vary in size between an open position and a more closed position;

a cord guide associated with the mouth in the top portion of the bag;

a first length of cord extending through the cord guide when the mouth is in the open position;

a second length of cord positioned outside of the cord guide when the mouth is in the open position, wherein the second length of cord has a substantially different diameter than the first length of cord.

19. The apparatus of claim 18 wherein the diameter of the first length of cord is less than half the diameter of the second length of cord.

20. The apparatus of claim 18 wherein the cord guide includes an opening having a diameter that blocks the second length of cord passing through the opening.

* * * * *